US006279747B1

(12) United States Patent
Zegarra

(10) Patent No.: US 6,279,747 B1
(45) Date of Patent: Aug. 28, 2001

(54) STUDY AID DEVICE

(76) Inventor: Diane Zegarra, 650 Main Rd. North, Hamden, ME (US) 04444

( * ) Notice: Subject to any disclaimer, the term of this patent is extended or adjusted under 35 U.S.C. 154(b) by 0 days.

(21) Appl. No.: 09/498,637

(22) Filed: Feb. 7, 2000

(51) Int. Cl.[7] ..... B65D 69/00; B65D 30/04; B65D 30/22

(52) U.S. Cl. ..... 206/579; 383/15; 383/40; 383/104; 383/119; D9/305

(58) Field of Search ..... 383/39, 40, 104, 383/119, 121, 14, 22, 108, 15, 38; 224/578–580; 206/541, 548, 542, 579, 314, 331; 150/118, 900, 902; D9/305; D3/283

(56) References Cited

U.S. PATENT DOCUMENTS 2,678,768 * 5/1954 Vergobbi ..... 383/119
3,121,452 * 2/1964 Hyman ..... 383/119
4,140,164 * 2/1979 Staup ..... 150/110
4,236,559 * 12/1980 Archbold ..... 150/110
5,385,766 * 1/1995 Ferre' ..... 383/40
5,813,445 * 9/1998 Christman ..... 383/38

* cited by examiner

*Primary Examiner*—Stephen P. Garbe
(74) *Attorney, Agent, or Firm*—Thomas L. Bohan; Patricia M. Mathers

(57) ABSTRACT

A device to aid in study and learning including a fabric bag having external pockets with transparent outer panels for holding study materials, such as homework or other papers associated with a course of study, and accessories for writing on and working with the study materials. The bag is made to the size of a standard breakfast cereal box so that the box can be placed inside of the bag so as to provide both support for the bag—so that the study materials are displayed upright for ready viewing—and a writing surface, so that the study material may be worked with by marking on the transparent outer panels. Closing straps are provided such that the straps may be secured out of the way for unhampered pouring of the contents of the box. Methods of use facilitate assisted study, such as a parent assisting a child during the breakfast hour, as well as individual study and study by two individuals concurrently. For use by young children, the primary colors, basic shapes, exhortatory sayings and the like may be printed, painted, or embossed on the bag and/or its accessories such as an eraser, markers and the like.

9 Claims, 5 Drawing Sheets

STUDY AID DEVICE

BACKGROUND OF THE INVENTION

1. Field of Invention

The invention relates to the field of education. In particular, the invention relates to aids to education and study, including self-education and assisted learning and specifically to a device for the display and manipulation of information to be learned, studied, noted, or reviewed and a method of use of the display to assist in the learning of the information. More particularly, the present invention relates to such a display device shaped to go over and be supported by a breakfast cereal box or the like and having pockets to hold and display information for reading and writing as well as pockets to hold writing-related implements, and also to a method for use of the device as a creative aid to study and learning.

2. Prior Art

In the field of education, much of the study and learning of information is done outside of the educational venue and of the formal course work structure and, in particular, much of it is done in the home. This is true of institutionally delivered education, continuing education, and also of self-education. Such home and outside-the-classroom study and learning may comprise the reading and review of information, the repetition and memorization of information, and the drill in and practice of methods and procedures that were presented in the classroom or in the course materials.

However, the time-demands of contemporary society on individuals and families to whom education is important, and often essential, leave increasingly fewer opportunities to devote time solely to study and learning. As a result, much study and learning is being done "on the run," concurrently with or as part of other necessary activities. For example, travel, especially commuting, is rarely devoted solely to getting to the appointed destination. Some drivers are able study and inform themselves by listening to audio tapes; nearly all riders are able to study, learn, and practice by reading and writing, and many do. High school and college students commonly do their homework while listening to music, watching television, and/or talking on the telephone. Meals are another activity commonly combined with study and learning, and in fact the tradition of informing oneself by reading the daily newspaper at breakfast is time-honored.

Furthermore, when study and learning requires or will benefit from the assistance of another person, such as the assistance of children by parents, opportunities that bring two people together for the purpose of study are even rarer in the modern household than are opportunities for individual study. In this case, mealtimes are often the only such opportunities, and breakfast is the meal during which two or more household members are most likely to be found together.

Several schemes and devices have been disclosed that make use of the presence of the cereal box at the breakfast table and of the propensity of people to look at and read what may be printed on it. Many cereal boxes have been manufactured so as to incorporate removable coupons, decal, and stickers having some premium value as an inducement to buy the cereal product. Otto et al. (U.S. Pat. No. 5,104,124) proposes a structure laminated to a side of the box and having or providing pockets for the purpose of holding collectible items or other premium items. Bernard et al. (U.S. Pat. No. 5,104,124) demonstrates an entire game laminated onto the side of a box, using the box as a supporting structure, as a value-added premium and inducement to buy the product.

Such previously taught devices and structures, however, have been manufactured as an integral part of the box, are usually disposed of with the box, have no use apart from the box, or have no purpose unrelated to the cereal product. Such devices are generally designed solely to enhance the value of the product contained in the box, to promote that product, or to hold items or display information related to the product and its commercial value. Further, such devices provide no opportunity to incorporate into them materials of the user's choice of various sizes and types.

Many devices incorporate pockets of various sizes for holding a variety of items. For example, Blackman (U.S. Pat. No. 5,002,401) discloses such a carrier device constructed of fabric and having a number of pockets to hold a variety of items. Likewise, Pell et al. (U.S. Pat. No. 5,494,366) shows an organizer notebook having a number of pockets intended to hold, separately, paper items and writing implements. In both cases, as in many similar devices, the pockets are provided on the inside of a foldable structure meant for organizing and transporting the items held in the pockets. Struhl (U.S. Pat. No. 5,275,438) shows an example of an external pocket intended to contain an item (in this case, specifically a computer disc) related to the contents of the folder into which the pocket is incorporated. However, the purpose of this pocket, whether or not it is made of transparent material, is to organize and transport its contents, and is not suited for the display of materials for study.

Ditzig (U.S. Pat. No. 4,717,021) teaches a container for video cassettes having external, transparent pockets for the display of printed matter. Similar external, transparent pockets can be found commonly on such items as loose-leaf binders. It is the purpose of such pockets to hold printed matter so that it can be read from the outside of the container without the need to open the container to determine what is inside. And so it is a primary purpose of the information displayed in such external, transparent pockets to identify the contents of the container—or the subject of the contents of the loose-leaf binder—usually by means of titles, illustrative graphics, and descriptive text. It is a further important purpose of the information displayed in such pockets as are incorporated into containers of commercial products, such as the video cassette container of Ditzig, to advertise and promote the contained product and other related products. For those reasons, it is a feature of such pockets that the items held in them are difficult to remove, and so are difficult to change. In fact, as anyone will attest who, preparing for a presentation, has tried to quickly and efficiently insert title pages into such pockets on loose-leaf binders, it is often nearly as difficult to fill such pockets in the first place as to remove the inserts afterwards. Consequently, insertion of the display materials into the external, transparent pockets of commercial packages is typically done by machine. Thus it becomes difficult and undesirable for the original contents of the pockets to be changed and so be made to mis-identify the product or other material inside the container.

What is needed is a device with which to display a series of informational and study materials in a manner that is readily viewable, and also to hold readily accessible implements for writing on, marking, highlighting, and erasing the written or printed information. What is further needed is such a method and supporting device that can be used with common, everyday objects encountered in the home and in particular at locations in the home where students and others regularly gather. What is also needed is such a method and device that take advantage both of the relatively common practice of combining meals with reading and study, and especially that takes advantage of the particular opportunity for assisted study at the breakfast table.

SUMMARY OF THE INVENTION

The present invention takes advantage both of the relatively common practice of combining meals with reading and study, and of the likelihood that household members will be together at breakfast, by using an item most commonly found on the breakfast table, the breakfast cereal box, to serve as a support for a device to display subject matter to be studied or practiced, and also hold such study and practice materials as texts, worksheets, and facts lists, in a manner in which they can be worked with and marked on. In addition, the present invention makes use of the assumption that both adults and children can be seen to read whatever is printed on the cereal box as a matter of habit or, perhaps, of compulsion. The fact that there are relatively few sizes of cereal boxes is an advantage to the present invention in that the device can be produced in a limited number of sizes and still be applicable in most of the kitchens of this country.

It is an object of the present invention to provide a method of using the standard-size breakfast cereal box or the like to serve various needs unrelated to the function of the box as a container or to its function as a means of advertising and promotion. It is a further aim of the present invention to provide a method of using a standard-size cereal box or the like as the supporting structure for a device and method that will aid in learning, study, and practice, and in assisted learning, study, and practice. Yet further, it is an object of the present invention to provide a device that is re-usable, separate from the cereal box supporting structure, and constructed such that the information it displays and the items it holds are to be of the user's choice and purpose and directed toward aiding the user in learning, studying, and practicing. It is also an object of the present invention that the contents of its external, transparent pockets be easily and often changed and that it further be able to hold, readily accessible, implements for writing on, marking, highlighting, and erasing the written or printed information.

The phrase "standard-size cereal box" makes reference the one of a very few number of standard-sized boxes in which breakfast cereal is sold. Standard-sized cereal boxes all take on the shape of a rectangular prism. A majority of those found in the grocery store range are 11 to 12 inches in height, 7.5 to 8.5 inches in width, and 2.25 to 3.5 inches in depth. More specifically, some examples of standard-size cereal boxes include boxes with exterior dimensions of 11 inches in height by 7.5 inches in width by 2.25 inches in depth (KELLOGG Raisin Bran); 12 inches in height by 8.5 inches in width by 2.75 inches in depth (CHEERIOS) and 12 inches in height by 8.5 inches in width by 3.5 inches in depth (IGA Corn Flakes). This is not to say that these types of cereal do not occur in other sizes, but rather that these respective box sizes are quite common.

As an aid to individual and assisted study, drill, and practice in the pursuit of learning, the present invention provides for the ready display of printed material in an upright position in front of a student seated at a table. The device further provides for the concurrent display of a second set of printed material in a similar upright position in front of either a second student or a study assistant, such as a parent or sibling, seated at the same table. The device provides that the second set of printed material is not visible to the first student, nor is the first set visible to the second student or to the study assistant. The device further provides holders for various accessories, such as pointers, calculators, markers, pencils, and erasers. The totality of the device and accessories comprise a kit for study and learning at a table, and at the breakfast table during the breakfast "hour" in particular. Inherent in the device and accessories is a method for individual—and/or assisted—study, drill, and practice.

In the context of this disclosure, the term "student" shall refer to any person, child or adult, engaged in a course of study, whether formal or self-motivated.

The device of the Preferred Embodiment of the present invention is in the form of a bag having a bottom, four sides, an open top, and adjustable closures using such fasteners as those marketed under the VELCRO brand. Transparent pockets on the external surfaces of the four sides hold and display study materials, such as course papers and work sheets, and also hold implements, such as markers, pencils, and erasers, with which to work on and with the study materials. The bag is fabricated of heavy fabric, preferably heavy cotton and/or denim, or of fabric-like material such as leather or vinyl. The interior dimensions of the bag are made to the approximate exterior dimensions of one of the standard sizes of breakfast cereal boxes. The external panels of the transparent pockets, made of flexible, clear plastic such as are affixed to the external surfaces of the sides of the bag, preferably by being sewn into the fabric seams of the bag, so that the external sides of the bag form the interior panels of the pockets. In the alternative, complete pockets may be made of transparent plastic and then bonded to the external surfaces of the sides.

The bag is made of fabric material heavy enough that the bag will nearly stand upright on its own. As an aid to this, the bottom of the bag and the top, around the opening, may be reinforced with a stiff fabric, such as denim. The color and other characteristics of the fabric material may be chosen to be solely decorative or to be part of the educational nature of the device—e.g., to help children to learn their colors—or both.

A standard-size cereal box inserted into the bag from the top serves several functions: 1) The box provides a rigid structure to hold the bag upright. 2) The box adds mass to the structure so that the device is less likely to tip when pointed to or written upon. 3) The box provides a firm writing or marking surface. A cereal box is preferred for its size and its common presence on a breakfast table, but any box-like item may be substituted.

A pair of fabric straps preferably of denim material are attached to two opposite sides of the bag. After the box is inserted into the bag, the straps are laid across the bag's opening and are fastened together by an easily adjustable fabric fastener such as VELCRO. The straps close the bag securely over the box, keep the bag from slipping down (or up, depending on the exact bag design) on the box, and keep the fabric of the bag from wrinkling under the study materials displayed in the pockets. Further, in order to facilitate use of the box and its contents, such as pouring of cereal from a cereal box being used with the present invention, provision may be made to secure the straps, when unfastened, to the external sides of the bag using like fasteners such as VELCRO-type hook and loop fasteners.

Each of the two narrow sides of the bag has at least one pocket fashioned as described above, so that the two narrow sides will have two or more pockets of various widths (width being measured laterally across the sides of the box), heights (height being measured vertically on the standing box), and depths (depth being the attainable distance between the exterior panel and the interior panel of the pockets). One use of these pockets will be to hold the various accessory items making up a particular educational kit. These accessories may include, for instance, but are not limited to pens and pencils, markers, pointers, rulers, erasers and calculators. In the preferred embodiment, these accessories include at least one erasable marker for marking or writing on the outside of the clear plastic pockets and a compatible eraser.

Further, accessory pockets may include a closing flap of transparent or non-transparent plastic, or of fabric such as denim, in order to retain the accessory items. Another use of these narrow-side pockets will be to hold and display prefabricated study aids such a flash cards.

Each of the two broad sides of the bag will have at least one large pocket fashioned as described above, so that the broad sides will have two or more pockets of various widths, heights, and depths. In the preferred embodiment, each of the broad sides of the bag will have one large transparent pocket of minimal depth that is high and wide enough to completely contain and securely hold a standard (8.5" by 11") piece of paper. In order to hold ordinary writing paper in these pockets, and still to permit the paper to be withdrawn and inserted easily and quickly, the interior dimensions of the bag are made sufficiently larger than the exterior dimensions of the box so that the contents of the pockets can be easily exchanged, while remaining snug enough to hold the inserted papers flat against the box. Other pockets that may be included in these broad sides, depending on the overall size of the particular bag and the space remaining, may be used to hold additional accessory items or additional study aids such as index cards.

In use, the bag, supported by the box, stands upright on the table in front of the student, between two students, or between the student and the study assistant. In use by an individual student, the material to be studied is inserted into one or more pockets on either or both of the broad sides. The study material is held upright in front of the student for easy viewing and reference. The study material is thus accessible for the student to use the accessories of the kit in the narrow-side pockets, such as the erasable marker and eraser of the preferred embodiment, to work on or with the study material. The student may have study material on both broad sides and also on one or both of the narrow sides, and may creatively employ the device in a variety of ways as an aid to study. For example, the student may insert questions or problems on one side and answers or solutions on the other, or the student may insert facts to be learned on one side and questions about the facts on the other. The device is easily rotated to reveal one side or the other.

In use by two students, each student will have his or her own study material in easy view, and each will have convenient access to the kit's accessories.

In use by a student and a study assistant, a wide variety of creative uses are available to make study effective and fun. As above, the student's side may display problems, questions, or puzzles while the study assistant's side reveals solutions, answers. or hints; or the student's side may display study text while the study assistant's side holds questions about the study text. Especially where a parent is assisting a child in study, a number of creative study games are possible. For example, a pocket on the child's side may hold a bundle of cards with problems to be solved or things to be identified while on the parent's side is a similar series of answer cards or a list of correct answers, and the child would be permitted to remove a card and place it on the table after a correct answer or required to remove the card and re-insert it at the back of the bundle after an incorrect answer. As another example, each side may hold different work sheets and, while the student, using erasable markers, completes the worksheet on one side, the parent may be correcting the completed worksheet and replacing it with another. As each worksheet is completed the box is rotated. A time limit may be set, and a timer, such as a simple egg timer, may be included in the kit.

Thus the present invention provides a solution to the scarcity of time for study, and especially for assisted study by parents of children, in modern life, by providing a device and method for using meal times, particularly the breakfast "hour," for such study.

DETAILED DESCRIPTION OF THE PREFERRED EMBODIMENT

Figure 1:
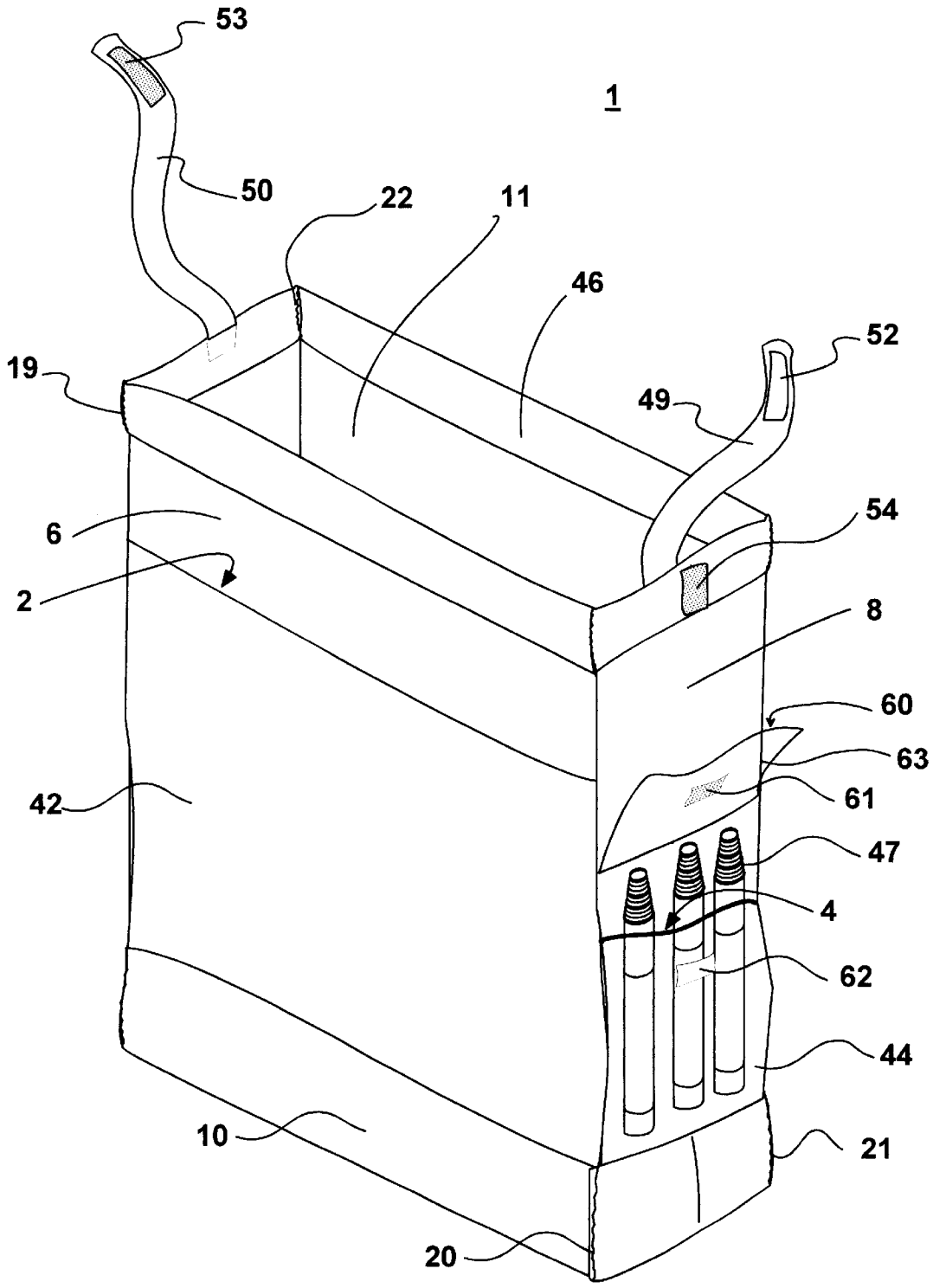
FIG. 1 Anterior view of the fabric bag of the present invention shown holding erasable markers in its right-side external pocket.
Figure 2:
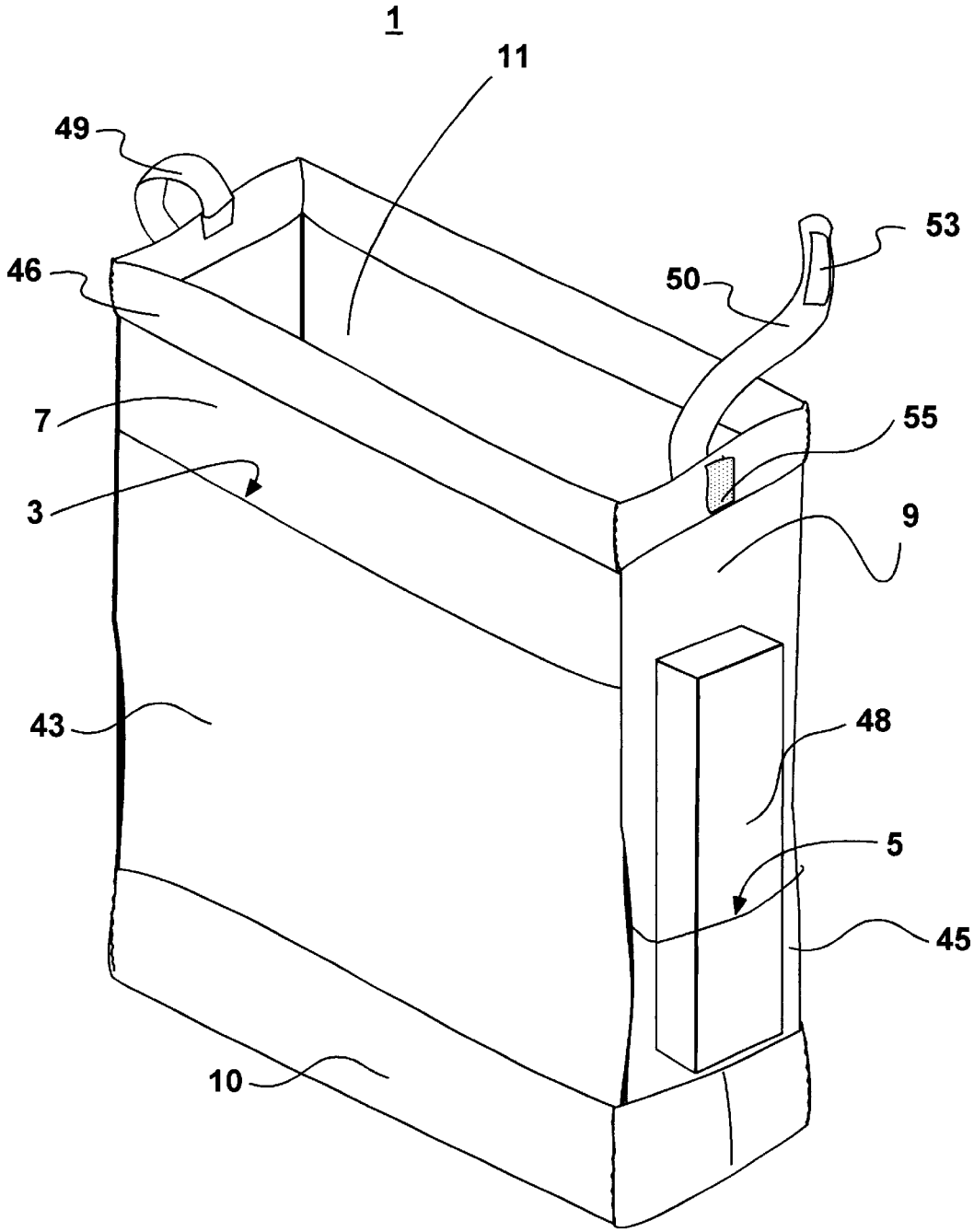
FIG. 2 Posterior view of the fabric bag of the present invention shown holding an eraser in its left-side external pocket.
Figure 3:
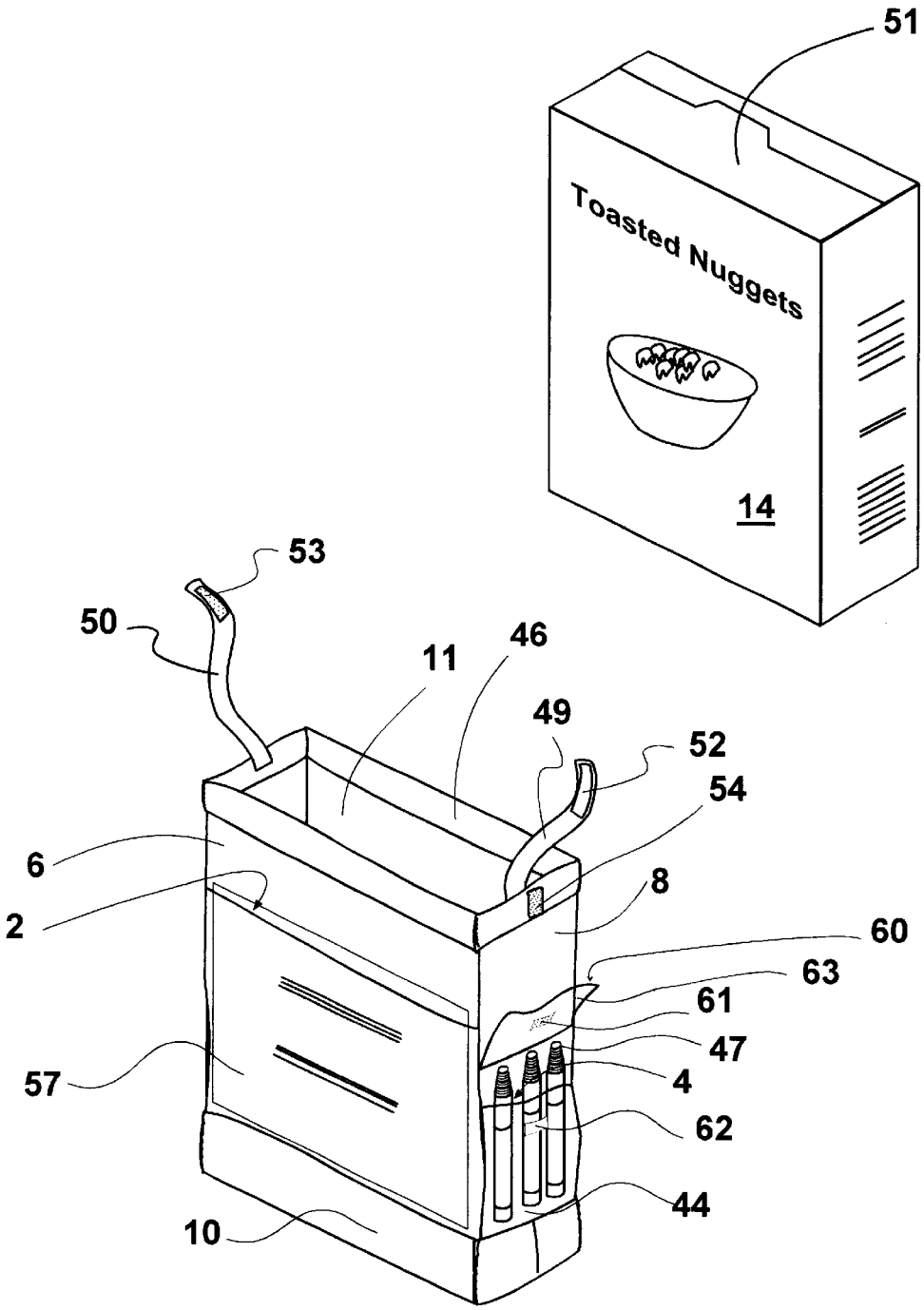
FIG. 3 Standard-size cereal box shown juxtaposed with the fabric bag, the latter shown holding erasable markers in its right-side external pocket and with study material having been inserted into its anterior-side external pocket.
Figure 4:
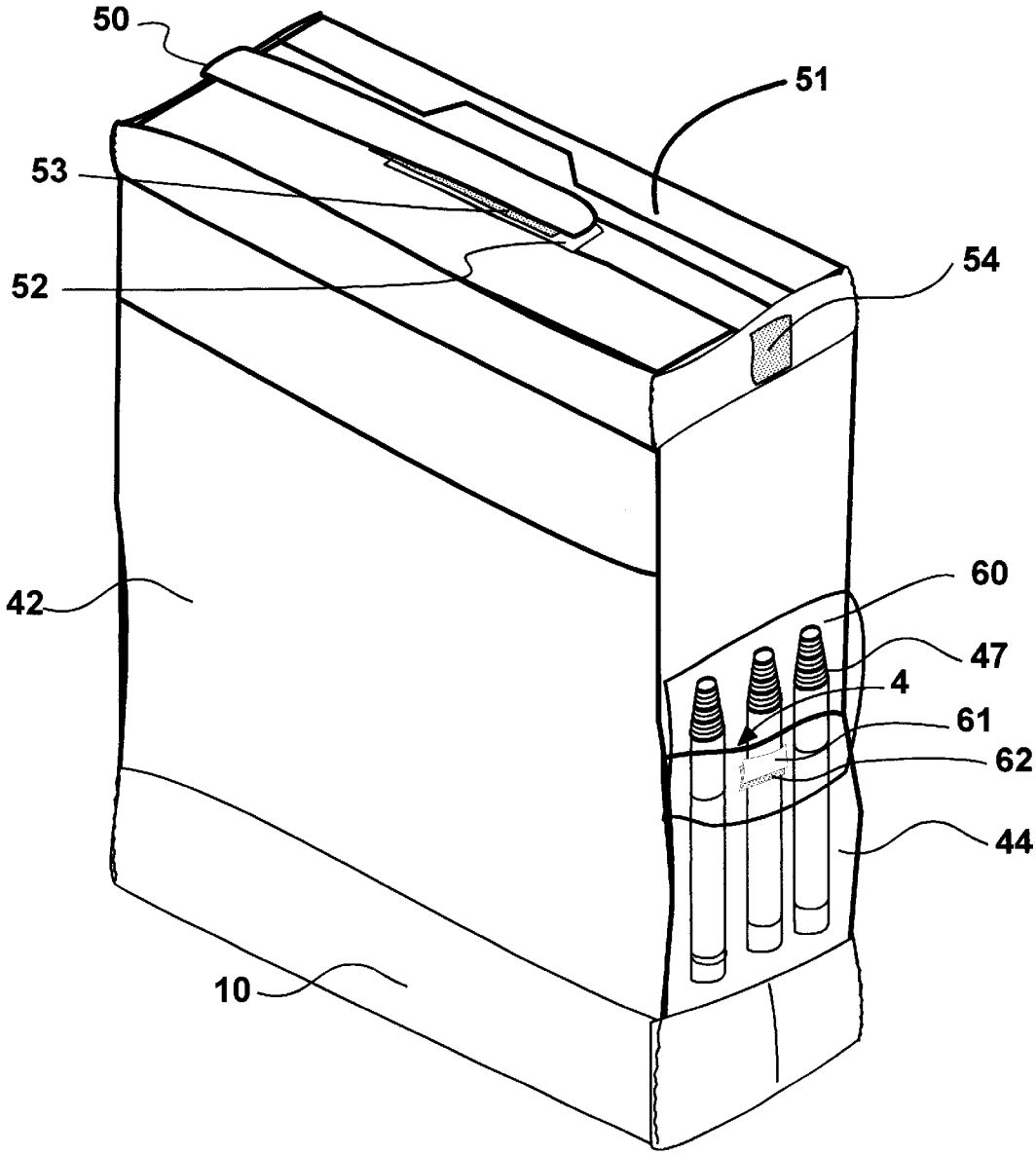
FIG. 4 Partial view of the fabric bag showing the closure of the straps across the top of an inserted cereal box.
Figure 5:
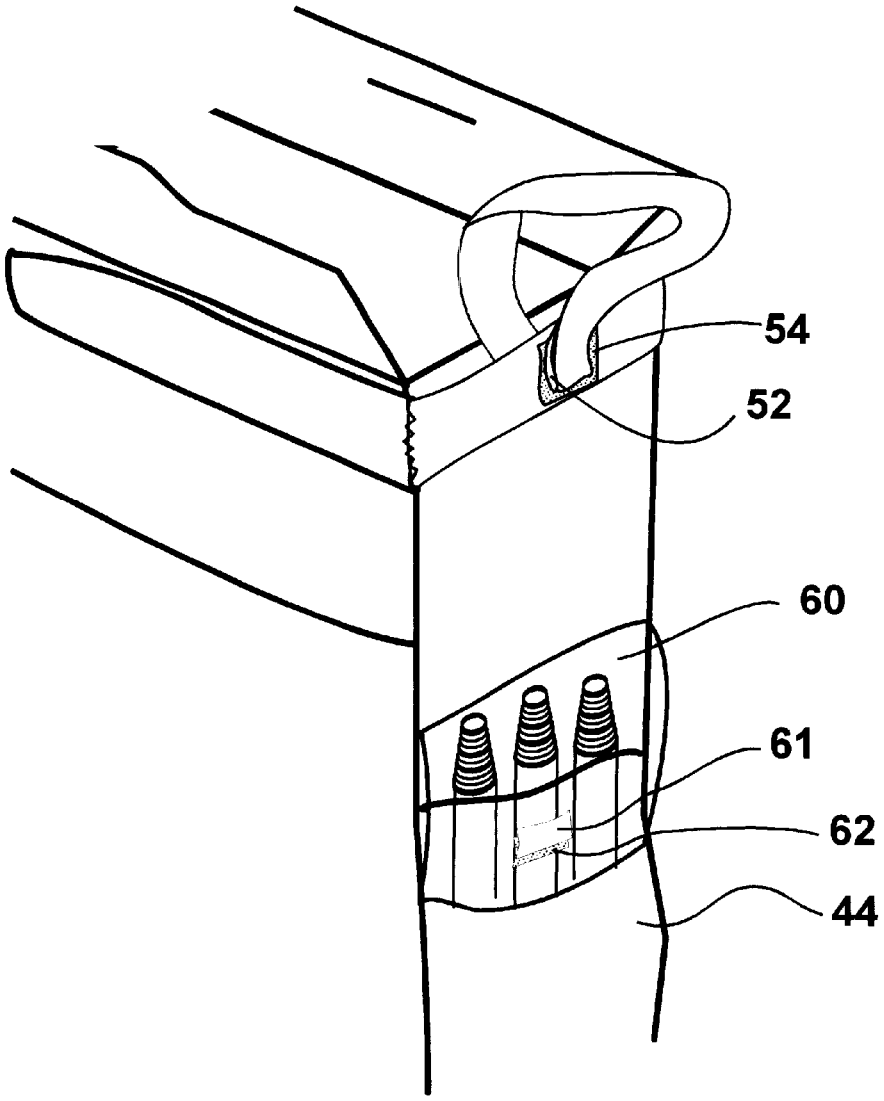
FIG. 5 Detail of the upper right corner of the fabric bag with a cereal box inserted, showing the manner of tying down the fabric straps.

As is illustrated in FIG. 1, FIG. 2, and FIG. 3, the Preferred Embodiment of the present invention is a kit built around a fabric bag 1 equipped with a plurality of external pockets. The fabric bag 1 has four vertical sides consisting of anterior side panel 6, posterior side panel 7, right side panel 8—"right" with respect to anterior side panel 6—and, likewise, left side panel 9. Said fabric bag 1 has a rectangular opening 11 at the top with a reinforcing band 46 attached over the top edges of the joined side panels along the perimeter of said rectangular opening 11, and a bottom piece 10 that closes the rectangular bottom and also wraps onto the sides in order to afford shape, stiffness, and reinforcement for said fabric bag 1.

The Preferred Embodiment includes a set of kit items including one or more erasable markers 47 and an eraser 48. The selection of particular kit items is directed toward the purpose of a particular exemplar of the kit, said erasable markers 47 and said eraser 48 being suited to the particular purpose to which the kit of the Preferred Embodiment is directed, namely the assisted education of kindergarten and elementary-school children at the breakfast table. In the Preferred Embodiment, said erasable markers 47 are of the type that may be found commercially for erasably marking on vinyl or other transparent sheet materials, and said eraser 48 is a compatible eraser suitable for erasing the marks made by said erasable markers 47.

In the Preferred Embodiment the interior dimensions of said fabric bag 1 coincides with the exterior dimensions of a standard-sized breakfast cereal box 14. Standard-sized cereal boxes all take on the shape of a rectangular prism. The invention makes use of the fact that there are a limited number of sizes in which said fabric bag 1 has to be manufactured, because of the limited number of breakfast cereal box sizes on the market. These sizes range from about 11 inches to about 12 inches in height, from about 7.5 to about 8.5 inches in width, and from about 2.25 to about 3.5 inches in depth. More specifically, some examples of standard size cereal boxes include boxes with exterior dimensions of 11 inches in height by 7.5 inches in width by 2.25 inches in depth (KELLOGG Raisin Bran); 12 inches in height by 8.5 inches in width by 2.75 inches in depth (CHEERIOS) and 12 inches in height by 8.5 inches in width by 3.5 inches in depth (IGA Corn Flakes). Other brands of cereals might have dimensions that differ slightly from these examples. However, more particularly the interior dimensions of said fabric bag 1 are somewhat greater in all directions than the exterior dimensions of the standard-size cereal boxes 14 over which the bag is manufactured to fit. The standard cereal box sizes preferred for use with this invention are those having an exterior width of 8.5 inches or greater, so as to accommodate the common width of paper in use in the schools and elsewhere. (It can be seen that if 8.5×11 inch paper can be accommodated, the A4 size can be as well.)

The fabric composing said anterior side panel 6, said posterior side panel 7, said right-side panel 8, and said left-side panel 9 is heavy cotton in the Preferred Embodiment. In the Preferred Embodiment, no two of these panels are the same color. The four side panels of said fabric bag 1 are joined together by being sewn along their long sides so as to form left anterior seam 19, right anterior seam 20, right posterior seam 21, and left posterior seam 22. Said bottom piece 10 and said reinforcing band 46 of said fabric bag 1 are made of a fabric that is stiffer and more durable than the cotton fabric composing the side panels, such stiffer fabric as denim. Said bottom piece 10 and said reinforcing band 46 may be of colors different from any of the side panels and also of colors different from each other.

Each side of said fabric bag 1 has a pocket that is accessible from the outside of the fabric bag 1 each said pocket being formed by sewing a transparent outer panel to each fabric side panel. Anterior-side pocket 2 is made from anterior outer panel 42 and anterior side panel 6; posterior-side pocket 3 is made from posterior outer panel 43 and posterior side panel 7; right-side pocket 4 is made from right outer panel 44 and right side panel 8; and left-side pocket S is made from left outer panel 45 and left side panel 9. The material making up said anterior outer panel 42, said posterior outer panel 43, said right outer panel 44, and said left outer panel 45, is a flexible, transparent material that can be attached by stitching, such as transparent vinyl, preferably without the use of adhesives. Said anterior outer panel 42 is secured to the exterior surface of said anterior side panel 6 by being sewn into said left anterior seam 19 and said right anterior seam 20, and by being sewn at the bottom under the vertical extension of said bottom piece 10. Likewise, said posterior outer panel 43 is secured to the exterior surface of said posterior side panel 7 at said right posterior seam 21, said left posterior seam 22, and under the vertical extension of said bottom piece 10; said right outer panel 44 is secured to the exterior surface of said right side panel 8 at said right anterior seam 20, said right posterior seam 21, and under the vertical extension of said bottom piece 10; and said left outer panel 45 is secured to the exterior surface of said left side panel 9 at said left posterior seam 22, said left anterior seam 19, and under the vertical extension of said bottom piece 10. Thus, the pockets are open at the top, and the width of each pocket is coincident with the width of each side to which it is attached. Further, due the transparency of outer panels, the contents of each external pocket will be visible from the outside.

Above said right-side pocket 4 closure flap 60 is attached to said right side panel 8 by being sewn horizontally across said right side panel 8 from said right anterior seam 20 to said right posterior seam 21 so that said closure flap 60 may be rotated down against said right outer panel 44 to close said right-side pocket 4 and rotate up away from said right outer panel 44 to provide access to said right-side pocket 4. A flap fastener 61, preferably a VELCRO-type fabric fastener, is affixed to the underside 63 of said closure flap 60, and a complementary pocket fastener 62 is affixed to said right outer panel 44, so that said closure flap 60 may be secured in the closed position. Said closure flap 60 of the Preferred Embodiment is made of fabric such as denim and may be monogrammed or otherwise marked.

The vertical dimensions of said anterior outer panel 42 and said posterior outer panel 43 are such that the top edge of said anterior outer panel 42 lies on said anterior side panel 6 below the lower edge of said reinforcing band 46, and, likewise, the top edge of said posterior outer panel 43 lies on said posterior side panel 7 below the lower edge of said reinforcing band 46. In contrast, the vertical dimensions of said right outer panel 44 and said left outer panel 45 are such that the top edge of said right outer panel 44 lies on said right side panel 8 at a point about half way between the upper edge of said bottom piece 10 and the lower edge of said reinforcing band 46, and the top edge of said left outer panel 45 lies on said left side panel 9 at a point about half way between the upper edge of said bottom piece 10 and the lower edge of said reinforcing band 46. This structure affords easy access to the interior of the pockets, because the fabric side panels can be easily pushed back from the transparent outer panels to allow an item to be inserted behind the transparent outer panels.

The "depth" of the external pockets is here-defined as the effective permitted distance between the respective outer panels and side panels. The "depth" of said anterior-side pocket 2 and the "depth" of said posterior-side pocket 3 will be made effectively nil, accommodating such content 57 as a few sheets of ordinary writing paper or paper board, when respective said anterior side panel 6 and said posterior side panel 7 are stretched flat. The "depth" of said right-side pocket 4 and the "depth" of left-side pocket 5, after said right side panel 8 and said left side panel 9, respectively, are stretched flat, are sufficient to permit the pocket to comfortably accommodate the kit items, said erasable markers 47 and said eraser 48. Typically they are at least one half inch.

A right fabric strap 49 is attached at the top edge of said right side panel 8, and a left fabric strap 50 is attached at the top edge of said left side panel 9. Said right fabric strap 49 and said left fabric strap 50 extend vertically from said opening 11 so that they may be laid across said opening 11. Fixed to an exterior side of said right fabric strap 49, near its free end, there is one component of a VELCRO-type fabric fastener 52. The complementary component of an adjustable fabric fastener 53 is fixed to the interior side of left fabric strap 50, likewise near its free end. The lengths of right fabric strap 49 and left fabric strap 50 are sufficient to permit adjustable fabric fastener 52 on right fabric strap 49 and adjustable fabric fastener 53 on right fabric strap 50 to mate, securing together the free ends of the straps within the opening 11 of the fabric bag 1 without reducing the interior width 12 of the opening 11. A commercially available hook-and-loop fabric fastener, such as Velcro®, is preferred; however, other fabric fasteners, such as snaps or buttons, may be used.

A tie-down 54 is fixed to right side panel 8 at the panel's horizontal center, below the lower edge of reinforcing band 46. At a similar position on left side panel 9, a similar tie-down 55 is also fixed. Tie-down 54 is a component of a VELCRO-type adjustable fastener that is complementary to the fastener component of adjustable fabric fastener 52, so that adjustable fabric fastener 52 will mate with tie-down 54. Likewise, tie-down 55 is preferably a component of a VELCRO-type adjustable fastener that is complementary to the fastener component of adjustable fabric fastener 53, so that adjustable fabric fastener 53 will mate with tie-down 55.

In use, a breakfast cereal box 14 is inserted into the fabric bag 1 so that the openable top 51 of the box 14 is accessible within the opening 11 of the fabric bag 1. Fabric strap 49 and fabric strap 50 are then laid across the top of the box 51, and fabric strap 49 is secured to fabric strap 50 by mating adjustable fabric fastener 52 of strap 49 to adjustable fabric fastener 53 of strap 50. The secured straps help to prevent the fabric bag 1 from slipping down on the cereal box 14, and, thus, keeps anterior side panel 6 and posterior side panel 7 stretched smooth beneath the paper content 57 of anterior-side pocket 2 and posterior-side pocket 3, so that the paper-like content 57 may be read and written upon without trouble. The cereal box 14 provides both a supporting structure for the fabric bag 1, and a firm writing surface under the paper-like content 57 of anterior-side pocket 2 and posterior-side pocket 3.

When it is necessary or desirable to pour the cereal or like contents of the cereal box 14, fabric strap 49 is unfastened from fabric strap 50 so that the cereal box 14 may be opened. To prevent the straps from interfering with the free pouring of the cereal, fabric strap 49 is secured to tie-down 54 on right side panel 8, and fabric strap 50 is secured to tie-down 55 on left side panel 9. In this Preferred Embodiment, tie-down 54 and tie-down 55 are fastener components complementary to fabric fastener 52 and fabric fastener 53, respectively. However, other systems of tie down may be employed, such as fabric loops into which the straps may be inserted.

The specific description provided here of the Preferred Embodiment is not intended to thereby limit the claimed invention. Clearly, there are other contexts in which the study aid device of the present invention can be used. There is, for example, no necessity to limit oneself to breakfast cereal boxes as a support for the device, even though that is one very common item that can be used and is particularly apt since it is present at what is often the scene of daily family gatherings or at least daily meetings of parents and children.

I claim:

1. A study aid device for use with a breakfast cereal box as support, said study aid comprising a bag open at the top and having a bottom, an anterior side, a posterior side, a right side, and a left side, said bag having a shape and size such that said cereal box can be placed into said bag, said bag having affixed to the outer surface thereof a plurality of panels serving to form pocket-receptacles for study tools such as sheets of paper, erasers, and erasable markers, wherein said plurality of panels includes an anterior panel and a posterior panel affixed respectively to said anterior said and to said posterior side of said bag, where at least one of said plurality of panels is transparent, wherein said plurality of panels also includes a right-side panel and a left-side panel, wherein said fours sides and said bottom of said bag are made of a soft fabric, wherein a stiffer reinforcement material covers said bottom and extends partway up said anterior side, said posterior side, said right side and said left side, wherein affixed to an upper part of said right side is a right-side strap and affixed to an upper part of said left side is a left-side strap, said right-side strap and said left-side strap being sufficiently long as to overlap when said left-side strap is extended toward said right side while said right-side strap is extended toward said left side and where said right-side strap is provided with a first coupling surface and said left-side strap is provided with a second coupling surface such that when said right-side strap overlaps said left-side strap said first coupling surface overlaps said second coupling surface with the result that said first coupling surface removably adheres to said second coupling surface, said first coupling surface being complementary to said second coupling surface, where an outer upper portion of said right side is equipped with a first adherent patch such that said right-side strap can be positioned so that said first coupling surface is put into contact with said first adherent patch causing said first coupling surface to removably adhere to said first adherent patch, and wherein an upper portion of said left side is equipped with a second adherent patch such that said left-side strap can be positioned so that said second coupling surface is put into contact with said second adherent patch causing said second coupling surface to removably adhere to said second adherent patch.

2. A study aid kit for use with a standard-size breakfast cereal box, said kit comprising:

(a) a fabric bag having four sides, a bottom, and an open top of such size and shape that the standard-size cereal box can be lowered into and substantially covered by said fabric bag, (b) one or more erasable markers, (c) an eraser, wherein said fabric bag is made of soft, colored cotton, wherein each of said four sides is a different color, wherein said bottom is reinforced with a stiffer material enabling said fabric bag to stand upright without need of additional support, wherein each of said four sides has affixed to it a transparent panel so as to form a pocket, resulting in an anterior pocket, a posterior pocket, a right-side pocket, and a left-side pocket, wherein said anterior pocket and said posterior pocket are both of a size and shape to accept a sheet of paper of standard size, wherein said right-side pocket is of such size and shape to accept several erasable markers, wherein said left-side pocket is of such size and shape to accept an eraser capable of erasing marks made by said erasable markers on said transparent panel, wherein attached to an upper portion of said fabric bag is a means of closing over said open top of said fabric bag such that the cereal box is removably fastened within said fabric bag, and wherein there is also a means for stowing said means of closing so that cereal can be freely poured from the cereal box while the cereal box is inside said fabric bag.

3. The study kit described in claim 2 wherein said heavy fabric is denim.

4. The study kit described in claim 2 wherein said heavy fabric is leather.

5. The study kit described in claim 2 wherein said heavy fabric is a flexible synthetic material.

6. The study kit described in claim 5 wherein said synthetic material is a polyvinyl material.

7. The study aid kit of claim 2, wherein said study aid kit is sized so as to fit over a cereal box having outside dimensions substantially equal to 11 inches in height, substantially equal to 7.5 inches in width, and substantially equal to 2.25 inches in depth.

8. The study aid kit of claim 2, wherein said study aid kit is sized so as to fit over a cereal box has outside dimensions substantially equal to 12 inches in height, substantially equal to 8.5 inches in width, and substantially equal to 2.75 inches in depth.

9. The study aid kit of claim 2, wherein said study aid kit is sized so as to fit over a the cereal box having outside dimensions substantially equal to 12 inches in height, substantially equal to 8.5 inches in width, and substantially equal to 3.5 inches in depth.

* * * * *